US006308700B1

(12) United States Patent
Lierse

(10) Patent No.: US 6,308,700 B1
(45) Date of Patent: Oct. 30, 2001

(54) PROCESS AND MANUFACTURING OF A ROTARY DIAMOND DRESSER FOR TRUEING AND DRESSING OF INDUSTRIAL GRINDING WHEELS

(75) Inventor: Tjark Lierse, Celle (DE)

(73) Assignee: DR Kaiser Co., Celle (DE)

( * ) Notice: Subject to any disclaimer, the term of this patent is extended or adjusted under 35 U.S.C. 154(b) by 0 days.

(21) Appl. No.: 09/426,263

(22) Filed: Oct. 25, 1999

(51) Int. Cl.[7] ..... B28D 1/00; B24B 53/00
(52) U.S. Cl. ..... 125/2; 125/5; 125/39
(58) Field of Search ..... 125/5, 2, 11.01, 125/11.03, 36, 38, 39

(56) References Cited

U.S. PATENT DOCUMENTS

| | | | | |
|---|---|---|---|---|
| 2,560,654 | * | 7/1951 | Lohutko | 125/36 |
| 2,776,529 | * | 1/1957 | Osplack | 125/5 |
| 3,154,064 | * | 10/1964 | Koebel | 125/39 |
| 3,347,219 | * | 10/1967 | Wellborn | 125/39 |
| 4,411,250 | * | 10/1983 | Lach | 125/11.01 |
| 4,677,962 | * | 7/1987 | Loos et al. | 125/11.03 |
| 4,805,586 | * | 2/1989 | Borse | 125/11.01 |
| 4,892,082 | * | 1/1990 | Wedeniwski | 125/39 |
| 5,146,909 | * | 9/1992 | Ruark et al. | 125/11.01 |
| 5,335,976 | * | 8/1994 | Dummermuth | 125/5 |
| 5,622,526 | * | 4/1997 | Phillips | 125/11.01 |

FOREIGN PATENT DOCUMENTS

| | | | | |
|---|---|---|---|---|
| 2210267 | * | 9/1973 | (DE) | 125/39 |
| 2352844 | * | 4/1975 | (DE) | 125/39 |
| 292168 | * | 7/1991 | (DE) | 125/39 |
| 543633 | * | 3/1942 | (GB) | 125/39 |
| 2078145 | * | 1/1982 | (GB) | 125/39 |
| 314561 | * | 12/1984 | (JP) | 125/39 |

* cited by examiner

*Primary Examiner*—M. Rachuba
(74) *Attorney, Agent, or Firm*—Michael A Mann; Nexsen Pruet Jacobs & Pollard LLC

(57) ABSTRACT

The invention applies to a diamond dresser consisting of a rotary symmetric body on whose circumference and/or face is applied randomly distributed diamond particles. It is the task of the invention to use simple means to reduce the abrasion on the circumference of the dresser, and thus to achieve a substantial increase in the operational life of the dresser. The invention holds that closely-spaced radial running grooves that stretch to the circumferential edge of one face of the dresser in which oblong diamonds are inserted and fastened, or that in the circumferential edge tightly-spaced radial recesses are formed into which oblong diamonds are inserted and fastened. These oblong diamonds are radially arranged and their ends protrude beyond the circumference of the rotary symmetric body. The oblong diamonds substantially reduce abrasion to the circumference of the rotary symmetric body. The oblong diamonds fit more closely into their metallic mount than do diamond particles, and because the oblong diamond mount is outside of the contact area of the abrasive grinding tool to be dressed and the dresser, and therefore the oblong metal bonding mount is better and more intensively cooled than the metal bonding the diamond particles themselves. Therefore, it is understandable that these oblong diamonds very effectively protect the otherwise earliest at worn circumferential area of the dresser from abrasion.

5 Claims, 2 Drawing Sheets

PROCESS AND MANUFACTURING OF A ROTARY DIAMOND DRESSER FOR TRUEING AND DRESSING OF INDUSTRIAL GRINDING WHEELS

FIELD OF THE INVENTION

The present invention relates to dressers for trueing and dressing industrial grinding wheels.

BACKGROUND OF THE INVENTION

Dressers with diamond particles applied serve mainly to form surfaces of abrasive grinding tools which have been worn in operation. The forming of the abrasive grinding tool is done by a process where the surfaces of the abrasive grinding tool and the diamond dresser touch while rotating it different peripheral speeds. Such dressers are expensive, not only due to the cost of worn diamonds, but also due to the fact that only a small number of high accuracy dressers can be manufactured. Therefore, it is important that long dresser lifetimes are striven for. However, long dresser life is limited by abrasion to the diamond particle surfaces and the loosening of the diamond particle attached to the rotary symmetric body. The loosening of the diamond particle is caused by the vertical orientation or the diamond as well as the changed form of the diamond caused by abrasion and the low hardness resistance of the bonding metal to the heat of the dressing operation. Abrasion occurs first and foremost on the edges of the dresser since the diamond particles have lesser adhesion to an edge than they do to adjacent face.

SUMMARY OF THE INVENTION

The invention applies to a diamond dresser consisting of a symmetrical rotary body to which randomly distributed diamond particles are applied to the circumference and/or one of its faces and the process to manufacture. Diamond particles are applied to the dressers on their circumferential edge. i.e. directly on the circumferential edge or on the side surface adjoining the circumferential edge. The diamond particles are placed on the symmetrical body with metal bonding, and in this manner fastened to the surface of the rotary symmetric body. The fastening is done with galvanic or chemical plating.

The invention prevents the disadvantages of current state-of-the-art. It is the task of the invention to reduce, by simple means, the abrasion on the edges of the dresser, and thus achieve a substantial increase in dresser lifetime.

DETAILED DESCRIPTION OF THE PREFERRED EMBODIMENTS

Figure 2:
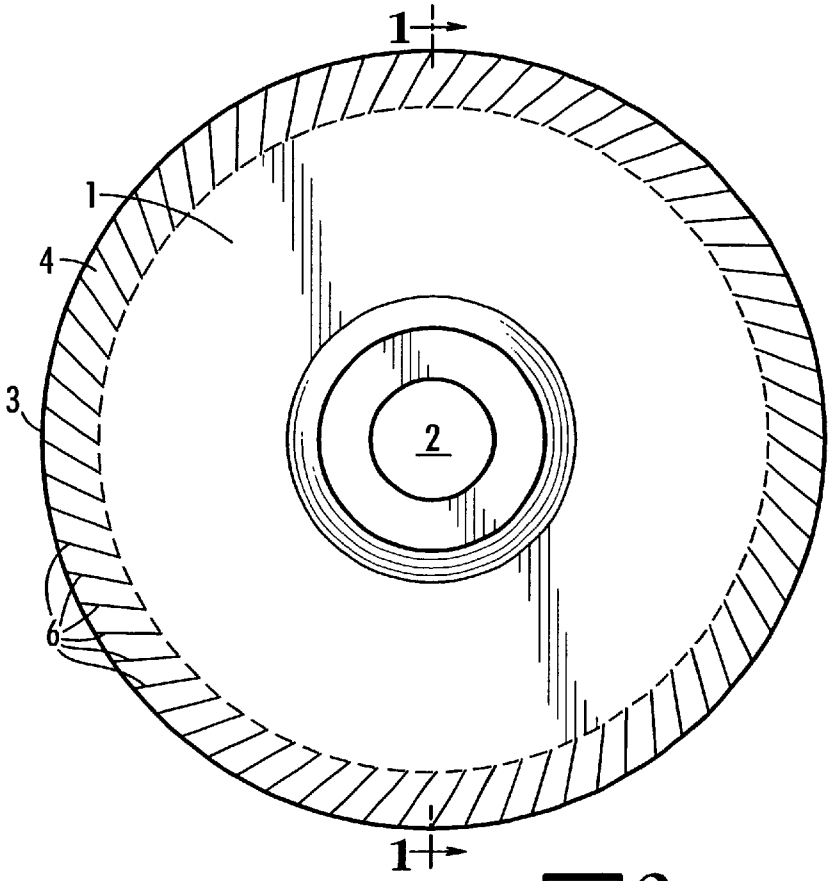
FIG. 2 is a view of the same Diamond Dresser shown in FIG. 1.

The invention applies to a diamond dresser consisting of a symmetrical rotary body to which randomly distributed diamond particles are applied to the circumference and/or one of its faces and the process to manufacture. Diamond particles are applied to the dressers on their circumferential edge. i.e. directly on the circumferential edge or on the side surface adjoining the circumferential edge. The diamond particles are placed on the symmetrical body with metal bonding, and in this manner fastened to the surface of the rotary symmetric body. The fastening is done with galvanic or chemical plating.

The invention holds that closely-spaced radial running grooves are formed on one face of the dresser to which oblong diamonds are placed or fastened; or that oblong diamonds are placed and fastened in the closely-spaced radial recesses formed on the circumferential edge. These oblong diamonds, which are mainly arranged in a radial manners, are placed so that the ends of the oblong diamonds protrude into the area adjoining the circumference of the rotary symmetrical body. The diamonds substantially reduce the abrasion of the dresser due to the following:

1. That the diamond has an oblong form;
2. That the diamonds are closely spaced around the circumference;
3. That the diamonds are held tighter in their metal bond made of galvanic or chemically cindered metal than diamond particles; and
4. That because the metallic bond holding the oblong diamonds is outside of the contact area of the abrasive tool to be dressed, the dresser is more effectively cooled than metal holdling diamonds at the contact point itself.

It is understandable that these oblong diamonds effectively protect what otherwise would be the earliest worn edges (i.e., on the circumferential edge of the dresser) from abrasion. The dresser is manufactured with recesses, either grooves or holes, which are closely spaced on the radial edge or circumference of the dresser. In these recesses, oblong diamonds are placed and are fastened in or on the dresser when cindered metals are placed in the recesses.

The oblong diamonds are very accurately positioned due to the precise nature of the grooves or recesses in the dresser. Therefore, the diamonds can be accurately arranged in the highest abrasion point and thus increase the lifetime of dressers. The highest abrasion points can be determined empirically or from abrasive wear calculations.

First, the oblong diamonds are attached to the dresser with a very small amount of glue. They are then fastened with a metal bond. The utilization of this manufacturing method insures that the oblong diamonds accurately fit on or in the dresser. The reduction of abrasion for diamond dressers can also be effectively performed with dressers with several stepped edges if oblong diamonds are closely placed radially at least one additional edge. To achieve longer dresser lifetime, it is advantageous if the oblong diamonds are arranged vertically or at an acute angle with respect to the axis of the dresser. For diamond dressers with several edges, the circumferential edge of the dresser still has diamond particles applied between every two oblong diamonds. The diamond particles are galvanically or chemically bonded to the dresser body. The oblong diamonds are arranged vertically or at an acute angle with respect to the axis of the dresser depending on the position of highest abrasion on the dresser. The essence of the invention is explained in Reference as follows in the schematic drawings.

Dresser Number 1

Figure 1:
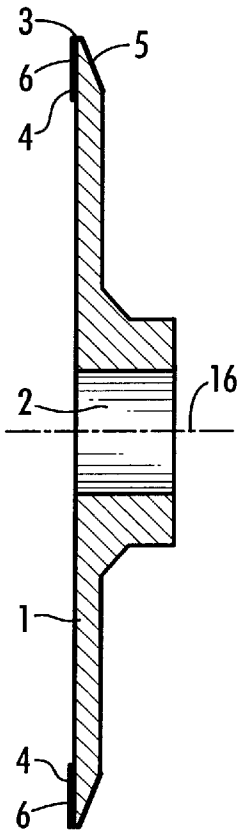
FIG. 1 is a section of a Diamond Dresser reinforced with oblong diamonds inserted in grooves.

In the schematic example of FIG. 1, the dresser, Reference #1, consists of a rotary symmetrical metal body that centrally shows the bore, Reference #2, for a shaft. Randomly distributed diamond particles are shown at the circumference in Reference #3 and on both facing sides in References #4 and #5.

In the schematic example of FIG. 2, the dresser, Reference #1, shows a ring-shaped layer of diamonds applied to the rotary symmetrical metal body. In the ring-shaped side area, Reference #4, the dresser has grooves in which oblong diamonds. Reference #6, are inserted. These grooves run to the edge of dresser body.

In the schematic examples of FIG. 1 and FIG. 2, the application of oblong diamonds, Reference #6, is on one side, double side applications are also possible.

Dresser Number 2

Figure 3:
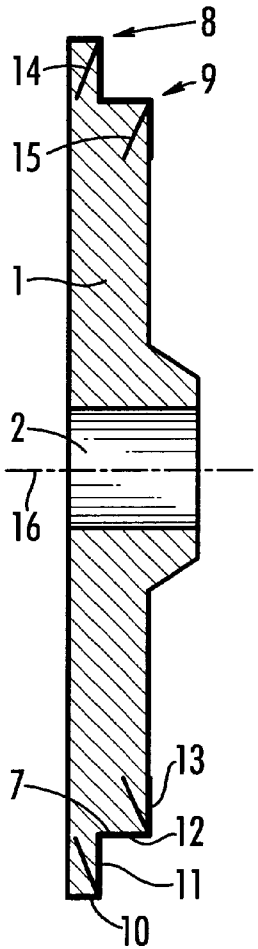
FIG. 3 is a section of a two step Diamond Dresser reinforced with oblong diamonds inserted in holes.

In the schematic example of FIG. 3, the dresser body, Reference #1, shows a step, Reference #7, and therefore two dressing edges, Reference #8 and #9 and four side areas, Reference #10, #11, #12, and #13, which are applied with randomly distributed diamond particles fixed with metal bonding. The edges, Reference #8 and #9, are reinforced with oblong diamonds which are inserted in holes, References #14 and #15. The diamonds are positioned at an acute angle to the axis of the dresser.

It will be apparent to those skilled in the art of dressers that many modifications and substitutions can be made to the foregoing description of preferred embodiments without departing from the spirit and scope of the invention, defined by the appended claims.

What is claimed is:

1. A diamond dresser, comprising:

a rotary body having two faces meeting at a circumferential edge, said rotary body having radial recesses formed at least one of said two faces and running to said circumferential edge;

randomly distributed diamond particles carried by said two faces; and oblong diamonds carried in said radial recesses to reinforce said circumferential edge.

2. The diamond dresser as recited in claim 1, wherein said oblong diamonds are adhered to said body with glue, and then fastened by metal bonding.

3. The diamond dresser as recited in claim 1, wherein said radial recesses are formed in both of said two faces.

4. The diamond dresser as recited in claim 1, wherein said rotary body has an axis and wherein said oblong diamonds are arranged at an acute angle with respect to said axis of said rotary body.

5. A diamond dresser, comprising:

a rotary body having plural circumferential edges, each circumferential edge having two faces meeting at said each circumferential edge, said rotary body having radial recesses formed at least one of said two faces and running to said each circumferential edge;

randomly distributed diamond particles carried by said two faces of said each circumferential edge; and oblong diamonds carried in said radial recesses to reinforce said each circumferential edge.

* * * * *